US005129293A

United States Patent [19]

Larson et al.

[11] Patent Number: 5,129,293

[45] Date of Patent: Jul. 14, 1992

[54] TORQUE CONTROL MECHANISM FOR WRENCHES AND THE LIKE

[75] Inventors: John K. Larson, Arlington Heights; Talmage O. Green, Schaumburg, both of Ill.

[73] Assignee: Precision Instruments, Inc., DesPlaines, Ill.

[21] Appl. No.: 713,381

[22] Filed: Jun. 10, 1991

[51] Int. Cl.[5] ..... B25B 23/159

[52] U.S. Cl. ..... 81/483; 81/478

[58] Field of Search ..... 81/467, 478, 480, 481, 81/483

[56] References Cited

U.S. PATENT DOCUMENTS

| | | | |
|---|---|---|---|
| 2,918,834 | 12/1959 | Cranford | 81/483 |
| 3,165,014 | 1/1965 | Grabovac | 81/483 |
| 3,270,594 | 9/1966 | Grabovac | 81/483 |

OTHER PUBLICATIONS

"Torque Tools" catalog sheet, No Date.

*Primary Examiner*—D. S. Meislin

*Attorney, Agent, or Firm*—Hill, Van Santen, Steadman & Simpson

[57] ABSTRACT

A torque control mechanism for wrenches and the like in which a pivot block has one end rockably engaging a force tranmsission member, an axially movable plunger has one end rockably opposing a second end of the pivot block, a ball screw carried by the plunger has a control ball element engaging the second end of the pivot block, a balance cam carried by the plunger provides seat for a coiled compression spring having its opposite end engaged by an antifriction device permitting the spring to turn for adjustment purposes, a rotatably adjustable transfer screw engages the antifriction device and is threaded through a stop adjusting nut mounted in the distal end portion of tubular housing for the mechanism. The distal end portion of the transfer screw is secured in an end cap fixed within a distal end of a handle mounted on the housing; and the components of the mechanism provide a continuous passage therethrough for respective adjustment wrenches to be applied from the handle end of the tool to respectively the ball screw, a ball screw lock screw, and to said balance cam.

19 Claims, 3 Drawing Sheets

TORQUE CONTROL MECHANISM FOR WRENCHES AND THE LIKE

BACKGROUND OF THE INVENTION

This invention relates to a mechanism for limiting the torque applied by tools, and is more particularly concerned with such mechanism in hand tools, such as wrenches and the like.

In hand tools, and the like, having torque controlling mechanisms, it is generally desirable to permit the torque release setting to be changed by the user as necessary. Customarily, different torque value adjustments can be quickly and easily effected with the assistance of a generally micrometer incremented scale and thimble operable by means of a handle on the tool. If torque release values are compared with tester readings at all micrometer settings from lowest to highest, a characteristic curve of linear progression of more or less comparable quantities is presented. The system of these comparisons represents the "spring rate". If the series of release values do not match the progression of all other micrometer settings accurately enough, the spring rate must be changed. In the case of all common torque tools (micrometer style wrenches), the spring rate can only be changed if the pivot block is substituted for one with more appropriate mechanical properties, i.e. of proper height. Changing the pivot block requires complete disassembly of the tool. Due to inherent variables with the design, it may take several trials with different blocks to obtain proper accuracy through the full range of settings. Spring rate change results from use of pivot blocks having different length-to-width ratio. Some suppliers of the above tools may provide as many as 40 types of replacement pivot blocks to attempt proper spring rate.

Prior torque limiting or controlling mechanisms have had no provision for calibrating both directions of rotation independently. Torque control may be required for items in the clockwise or counterclockwise direction or both. While torque wrenches, for example, may be set to release according to a setting in either direction, the calibration choice is limited to one direction or the other. For example, in a typical mechanism accuracy may be only within a plus or minus 4% of the reading in the clockwise direction and plus or minus 6% of the reading in the counterclockwise direction from 20% of the full scale reading to the full scale reading. Differences in the torque release values between clockwise and counterclockwise applications at the same setting are caused by variations in machining, variations in friction from side to side between plunger and side of case, variations due to coil spring orientation, etc.

In prior torque control mechanisms, no provision is made to cancel out the nonproportional torque output compared to the progression of torque settings. Due to the nature of the release mechanism which includes the pivot block operation, a non-linearity exists between the progression of spring compression (as dictated by transverse screw thread pitch) and the actual release torque. At the highest settings, the system completely "breaks over", i.e. releases, as soon as the initial spring pressure is overcome. An audible signal results. At lowest settings, when the initial spring pressure is overcome, the pivot block begins to rotate, but spring pressure increases at a greater rate than the decrease in force caused by the increasing block angle. This results in higher output torque release values to be realized at low settings and complete loss of the audible signal. The higher release values at low settings can be compensated for by selecting a shorter pivot block.

Attempts at calibration show that a "droop" now exists in prior mechanisms in the characteristic curve of the torque setting and release comparisons. For example, after selection and installation of correct pivot block and proper low setting, a 100 lb. ft. capacity torque wrench may be checked for accuracy at various settings. At a setting of 20, the release takes place at 20. At the highest setting of 100, the release takes place at 100. However, at a setting of 30, the typical release value in prior tools has been only 29. This non-linearity is typical for the prior torque wrenches utilizing pivot blocks. A greater allowance for accuracy variation must be made in the prior devices because of this non-linear function.

Prior devices of the kind under discussion have inadequate provision for efficient low value setting and exact alignment of scale to thimble increments. Initial settings are accomplished with the use of multiple spacers and washers requiring at least partial disassembly of the tool. Sets of solid disk spacers are used to allow for main springs of different lengths and to establish the lowest limit of tool torque release setting. Sets of washers of several thicknesses are generally used to establish proper alignment between the thimble and scale increments of the tools.

SUMMARY OF THE PRESENT INVENTION

It is accordingly an important object of the present invention to provide new and improved means for adjusting or calibrating the rate of torque release change at the output square drive coincident with the torque rate change indicated by the scale markings in a manner to avoid the need for changing the pivot block or the spring during manufacture or during service to accomplish the adjustments.

Another object of the invention is to provide new and improved means for changing from outside the tool the effective angle of the pivot block for changing the spring rate.

A further object of the present invention is to provide a new and improved pivot block controlling device for torque control mechanisms.

Still another object of the present invention is to provide for accuracy of torque applications in both the clockwise and counterclockwise directions in torque controlling mechanisms of the character indicated.

It is still another object of the invention to provide a new and improved spring mounting and controlling means for torque control mechanisms.

It is also an object of the present invention to substantially improve linearity of torque release mechanisms.

It is still a further object of the present invention to provide for component simplification, ease and accuracy of assembly and improved adjustability in torque control mechanisms.

To the attainment of the foregoing and other objects of the invention there is provided a torque control mechanism for wrenches and the like and having a drive head connected to one end of a force transmission member which is attached adjacent to such one end to a proximal end of an elongate tubular housing, and comprising a pivot block having one end rockably engaging a second end of the force transmission member, an axially moveable plunger having one end rockably opposing a second end of the pivot block, and a ball screw axially threadedly adjustable in a throughbore in the plunger and having pivot controlling ball means for projecting into engagement in a complementary socket in the second end of the pivot block.

There is also provided in such a mechanism balance cam means cooperatively related to a second end of the plunger for controlling balanced release values between clockwise and counterclockwise torque valuations, coiled compression biasing spring means seated at one end on the balance cam means for applying biasing thrust toward the plunger, antifriction means for compression engagement of a second end of the spring means, and rotatably adjustable transfer screw means having an end engaging the antifriction means for controlling the thrust load of said spring means.

In such mechanism there may also be provided a stop adjusting nut mounted in the distal end portion of the tubular housing and having the transfer screw means threaded therethrough, an end cap fixed within a distal end of the handle and having the transfer screw threaded therethrough, and the transfer screw having wrench engageable means for rotatably adjusting the transfer screw axially in said stop adjusting nut for effecting said adjusting of the load of the biasing spring means.

The transfer screw means, the antifriction means, the spring means, and the balance cam means provide continuous passage therethrough for access from the distal end of the handle by an adjustment wrench to the ball screw for controlling projection distance of the pivot controlling ball means relative to the plunger.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

DETAILED DESCRIPTION OF A BEST MODE EMBODIMENT

Figure 1:
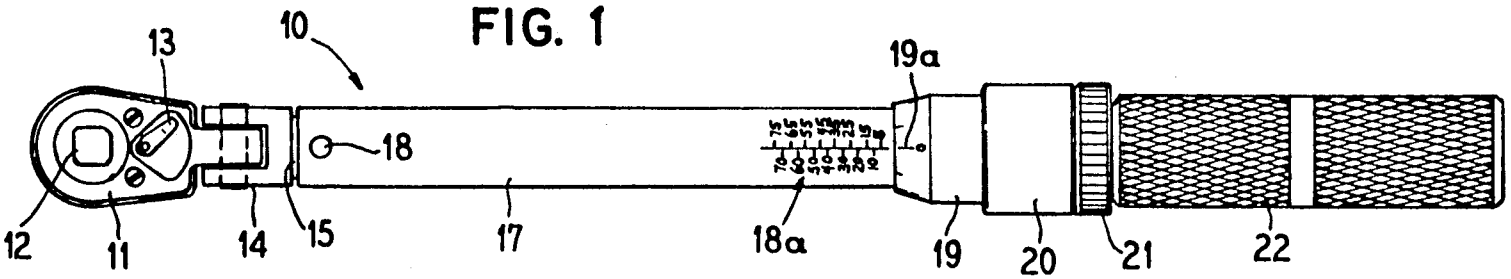
FIG. 1 is an elevational view of a micrometer adjustable click wrench embodying the new and improved torque control mechanism of the present invention.
Figure 2:
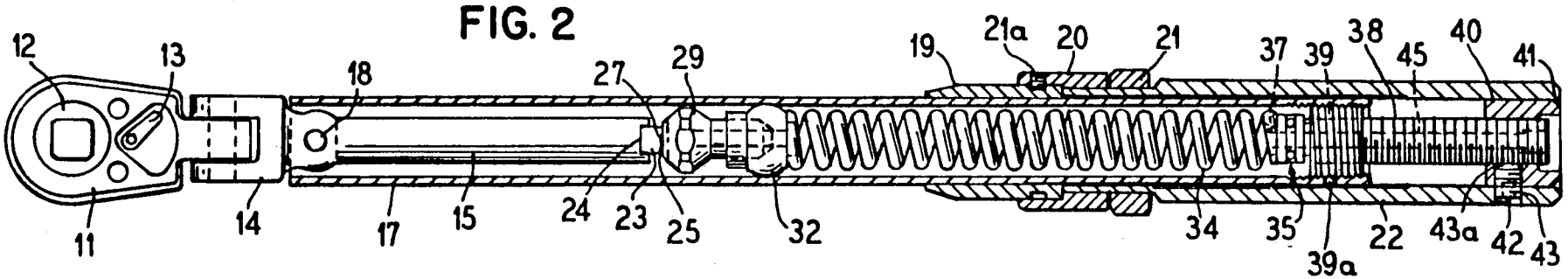
FIG. 2 is a view similar to FIG. 1 but showing internally thereof components of the torque control mechanism.

In FIG. 1, is depicted a tool 10 illustrative of the class of tools that can benefit from incorporation of the torque control mechanism of the present invention, and in this instance comprising a hand operated torque wrench. To this end, the tool 10 (wrench) has a drive head 11 embodying a rotary ratchet control output or drive member 12 and with the customary ratchet selecting lever 13 by which the drive member 12 can be controlled for either clockwise or counterclockwise driving torque. The head 11 is connected by means of a swivel knuckle 14 to the proximal, clevis head end of a force transmitting member 15 (FIG. 2) extending longitudinally in a tubular case or housing 17 which is attached at one end as by means of a pin 18 to the force transmission member 15 adjacent to its clevis end. Intermediate its ends, the tubular housing 17 has an incremented scale 18*a* with which is associated a conventional assembly including a thimble 19, a lock ring retainer 20 and a lock ring 21 attached to the proximal end of a handle 22.

Substantially simplified, easily and accurately adjustable torque control mechanism within the tubular housing 17, comprises a substantially rectangularly shaped pivot block 23 (FIGS. 2 and 4) having one end pivotally engaged in a centering groove 24 in the inner end of the transmission member 15. At a second end, the block 23 has a ball socket 25 within which is engaged a pivot controlling ball 27 integral with an end of a ball screw 28 axially threadedly engaged within an internally threaded throughbore 28*a* in a plunger 29. The ball screw has at its opposite end a wrench socket 30, such as may be receptive of a hex wrench for adjusting the ball screw axially within the plunger 29 for controlling the projection distance of the ball 27 from the plunger 29. For retaining the ball screw 28 in adjusted position, a lock screw 31 is threaded into the plunger bore 28*a* and is lockingly engageable with the adjacent end of the ball screw.

In assembly with the plunger 29 is a balance cam 32 which has one end engaged with the plunger 29 and has a second end provided with a reduced diameter boss 33 for centering one end of a coiled compression biasing spring 34, an opposite or second end of which is engaged against an antifriction bearing assembly 35 through which extends a centering terminal 37 of an elongate transfer screw 38 threaded through a stop adjusting nut 39 threadedly engaged in the outer or distal end of the tubular housing 17. At its outer distal end portion, the screw 38 is threadedly engaged through an end cap 40 fixedly secured as by means of welding 41 in the outer end portion of the tubular handle 22. For locking the transfer screw 38 in adjusted positions, a set screw 42 is threadedly engaged through a bore 43 in the wall of the handle 22 and an aligned bore in the wall of the end cap 40 and lockingly secures the transfer screw in adjusted position by means of a brass friction disk 43*a*.

Figure 7:
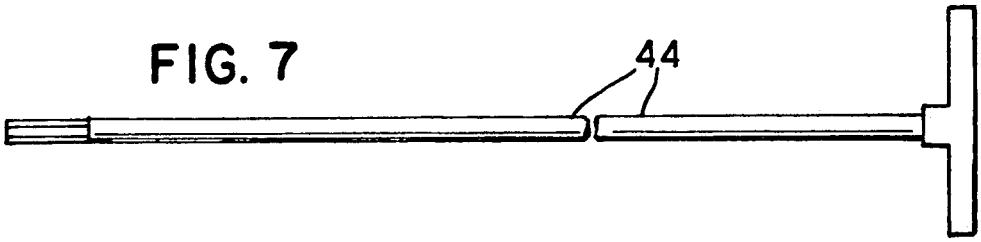
FIG. 7 is an elevational view of a hex wrench suitable for effecting adjustments of the ball screw assembly of the mechanism.

The mechanism as thus generally described is especially suitable for adjusting or calibrating the rate of torque release change at the output square drive 12 coincident with the torque rate change indicated by the incremented scale markings 18 without taking the tool apart to change the pivot block 23 or the spring 34 during original assembly or during service to accomplish the adjustments. Accordingly, the effective angle of the pivot block 23 for changing the spring rate can be effected from outside of the tool by application of a simple tool such as an elongated hex wrench 44 (FIG. 7) from the distal end of the handle 22 through a continuous passage through a longitudinal bore 45 in the transfer screw 38 and an aligned bore in the bearing assembly 35 and through the hollow interior of the spring 34, and a bore through the balance cam 32, and through the lock screw 31 into engagement within the ball screw wrench socket 30 as shown in FIG. 4.

Figure 4:
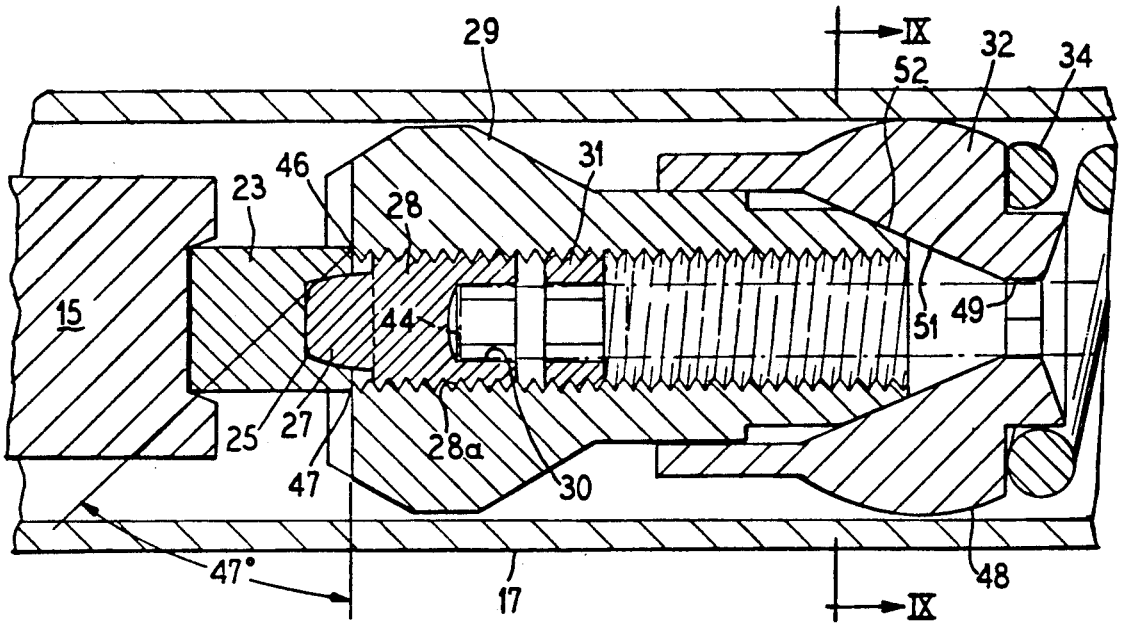
FIG. 4 is an enlarged fragmentary longitudinal detail view of the pivot block and ball screw components and associated parts of the torque control mechanism, in one adjusted portion thereof.

In one typical adjustment, as shown in FIG. 4, the ball screw 28 is backed into the plunger so that the adjacent pivot block 23 end face is in contact with the plunger face. The ball 27 keeps the pivot block 23 from sliding out of position with the plunger. With the components adjusted in this manner, the resistance to torque release is a function of the angle as derived from the opposite block corners, namely the highest resistance to release of the components available, a resistance angle of for example 47° being achieved.

Figure 5:
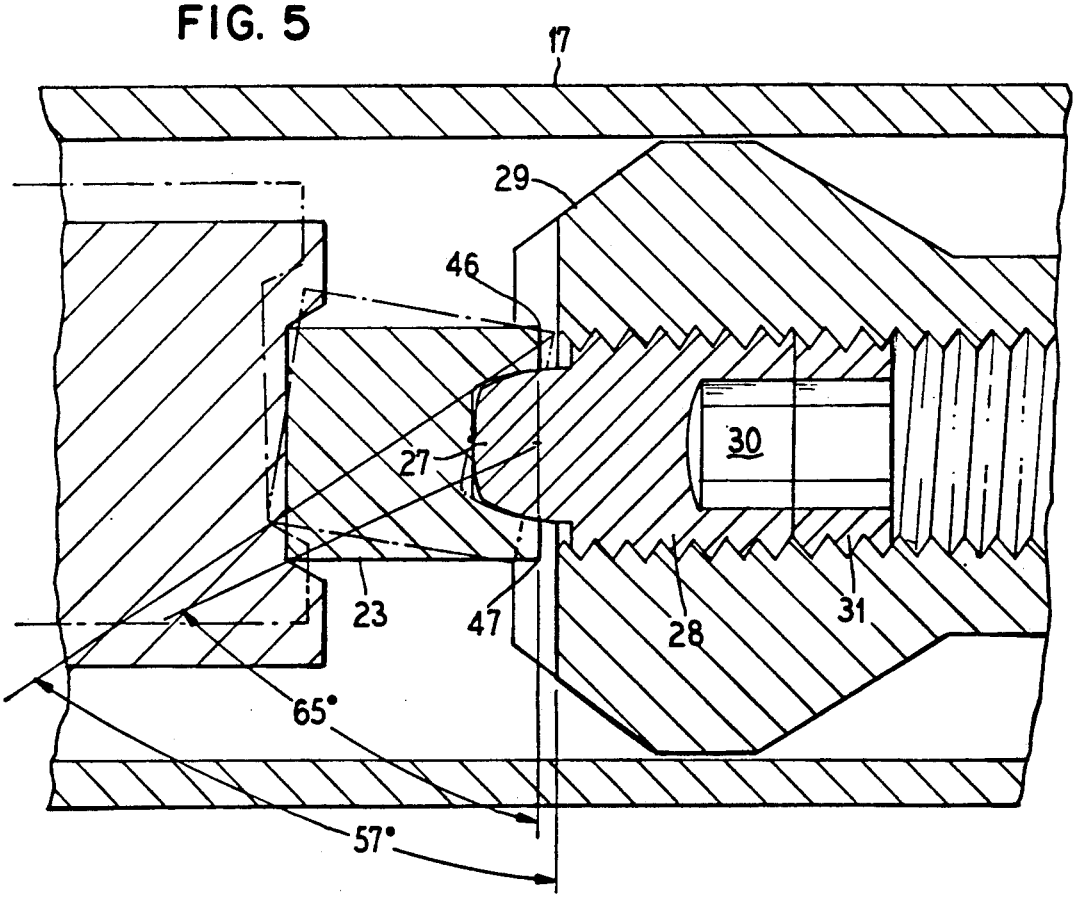
FIG. 5 is a view similar to FIG. 4 but showing another adjusted position thereof.

If a lower resistance to torque release is desired, the ball screw 28 is projected from the plunger 29 so that the pivot ball 27 thrusts the pivot block 23 into a spaced relation to the opposed face of the plunger. For example, in the relationship shown in full line in FIG. 5, the resistance angle is about 65° and when under sufficient torque force, the pivot block 23 is caused to pivot as depicted in a dash line showing in FIG. 5, to achieve torque resistance of about 57° as indicated.

Figure 11:
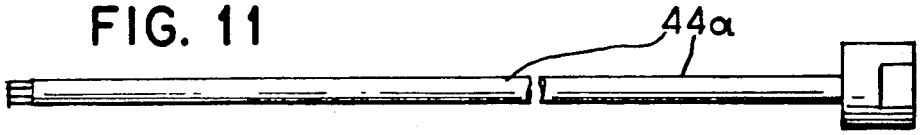
FIG. 11 is an elevational view of a hex wrench suitable to loosen and tighten lock screw of ball screw assembly.

When any adjustment of the ball screw 28 is to be effected, the lock screw 31 which has a hex wrench bore, is first backed off by a wrench 44*a* (FIG. 11) which is sufficiently shorter than the wrench 44 to clear the adjacent end of the ball screw 28. Any desired adjustment of the ball screw 28 is then effected by means of the wrench 44 engaged in the socket 30 through the lock screw 31, and the lock screw 31 is driven back into locking position against the end of the ball screw, by means of the wrench 44*a*.

Figure 3:
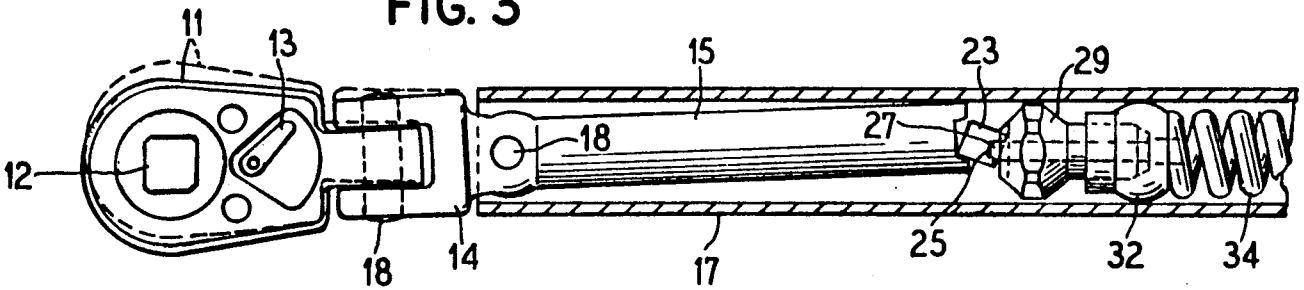
FIG. 3 is a fragmentary view similar to FIG. 2 but showing the mechanism at full torque release force application.

Whatever the torque release adjustment may be, when the tool is applied in service, the force transmission member 15 will swing toward the wall of the housing 17 as shown in FIG. 3, and the pivot block 23 is caused to pivot about its pivot point 46 in a clockwise torque maneuver or about pivot point 47 in a counterclockwise maneuver. As the pivot block 23 pivots, the plunger assembly and the components assembled therewith are pushed in opposition to the biasing spring 34. Spring load working through the pivot block 23 causes the pivot block to snap the transmission member 15 with sensible clicking impact against the adjacent wall of the housing 17 and a portion of the torque force is released. (Thereafter the mechanism is permitted to resume the at rest or start position for another torquing cycle.) Force on the handle must be released for the mechanism to return to the rest or start position.

Figure 8:
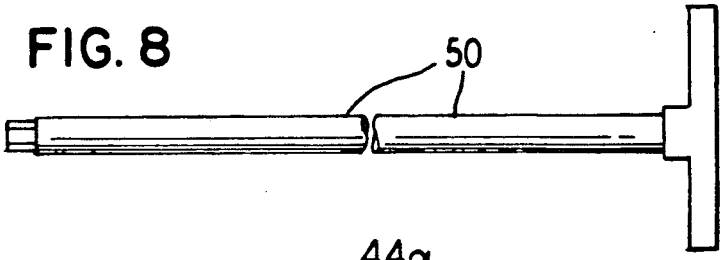
FIG. 8 is an elevational view of a hex wrench suitable for adjusting the balance cam component of the plunger cam assembly.

To provide accuracy of torque applications in both the clockwise and counterclockwise directions, a correlating adjustment feature affords matching clockwise and counterclockwise release values. To this end, the balancing cam 32 (FIG. 4) has a semi-globular surface 48 in sliding engagement with the wall of the housing 17 and acts as an intermediary for transmission of the spring load to the plunger 29 with which the balance cam is assembled. A hex bore 49 at the distal end of the balance cam 32, and larger than the hex socket 30, is adapted to receive an adjustment hex wrench 50 (FIG. 8) by which the balance cam is adapted to be rotated while the plunger 29 and the pivot block 23 and the force transmitting member 15 remain stationary. However, the spring 34 rotates with the balance cam since the end of the spring in engagement with the balance cam is frictionally held while the opposite end of the spring engages the antifriction bearing assembly 35.

Figure 9:
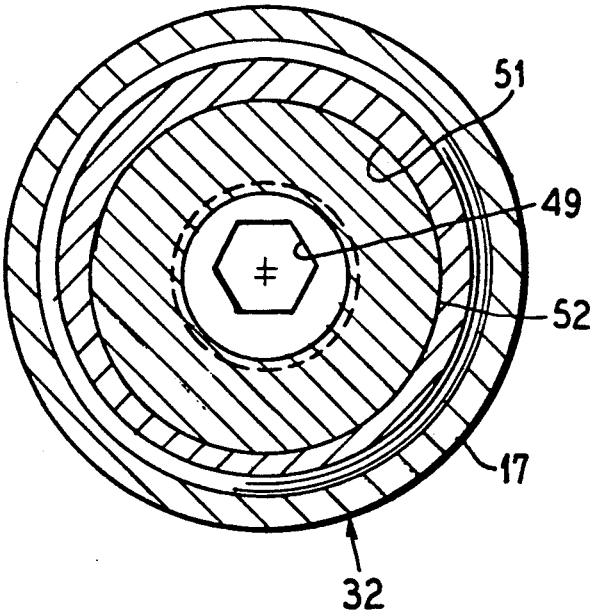
FIG. 9 is a view taken along the line IX—IX in FIG. 4.

Balanced release values between clockwise and counterclockwise torque applications are provided by two pressure variables controlled and directed by the balance cam 32. One variable is an inherent off-center pressure characteristic of the type of coil spring used for the spring 34. The off-center characteristic when the spring is rotated is used to cancel the effects of tool component machining differences and the like. A second control pressure directing variable is achieved by offsetting the alignment of the balance cam 32 with the plunger 29 slightly, effected by having a socket 51 (FIGS. 4 and 9) receptive of a complementary boss 52 on the plunger 29, and with the socket 51 slightly eccentric, e.g. 0.004". The latter control then results by turning the balance cam about its axis.

The present invention also provides for substantial reduction in nonlinearity of the torque release curve at different settings. The mismatching of proportional releases from lowest to highest settings is a function of excursion of the pivot block corner when the transmitting member force first overcomes the block interference which is a function of block angle and spring force on the plunger. Spring pressurizes so quickly at low settings as the block rotates, that the final release is increased and is partially a function of the increased spring pressure. Any decrease in plunger travel as the block becomes fully rotated will also decrease nonlinearity which will further enhance potential product accuracy. Testing has indicated that nonlinearity in the mechanism of the present invention is reduced by at least 50% of that for prior micrometer click wrenches.

Another valuable attribute of the present invention resides in that the tool 10 as described, provides for what may be referred to as "one time" assembly and service adjustment using only simple tools applied externally, and avoiding the need for washers, shims and spacers heretofore considered essential for the purpose.

Although assembly of the tool and, in particular, the torque control mechanism may already be evident to persons skilled in the art from the foregoing description, a summary of the assembly may be helpful to some persons, especially those persons who may not wish to read the more detailed description in order to gain a quick understanding of the mechanism.

To start with, it will be assumed that the ratchet drive head 11 will have been, as is customary, attached by means of the swivel knuckle 14 to the force transmission member 15. Then the case or housing 17 is attached by means of the pivot pin 18.

Figure 10:
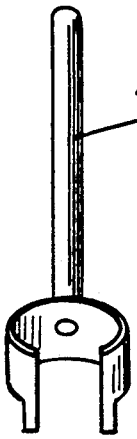
FIG. 10 is an elevational view of a spanner wrench suitable for adjusting stop adjusting nut.

Thereafter, in order, the pivot block 23, the plunger assembly 29, the balance cam 32, and the main spring 34 are inserted into the housing 17 from the handle end of the tool. Next, the components comprising the bearing assembly 35, the transfer screw 38 and stop adjusting nut 39 are inserted. The stop adjusting nut 39 is threaded into the distal end of the case or housing 17 so that with the transfer screw seated against the nut the mechanism releases at the lowest setting to be allowed, the wrench 44b FIG. 10 being used to set the stop adjusting nut 39 at this lowest setting. The stop adjusting nut 39 is turned to allow alignment between the nearest milled slot in the adjusting nut 39 and the stop positioning ball case hole in the housing 17. The stop adjusting nut 39 is then secured using stop positioning balls 39a to the housing 17. The first important assembly step has been completed, which has positioned the low setting stop without spacers.

Figure 6:
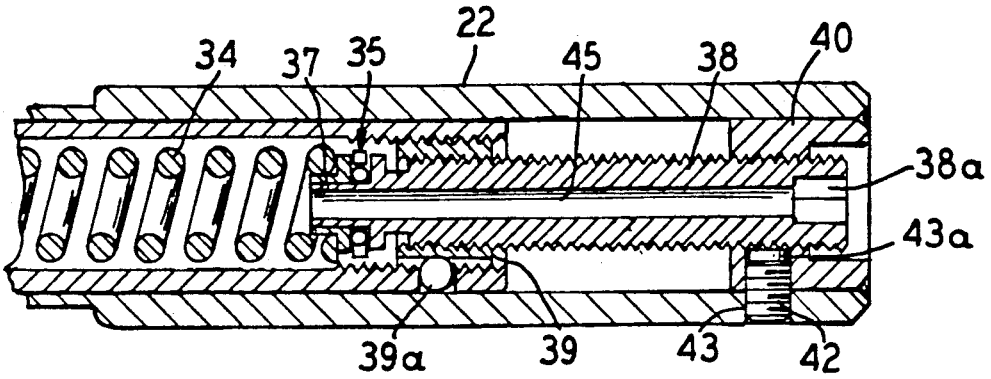
FIG. 6 is an enlarged fragmentary sectional elevational view showing components at the handle end portion of the tool.

The conventional handle assembly which comprises the end cap 40, the tubular handle 22, the lock ring retainer 20, the thimble 19 and all lock components, is slid over the tubular housing 17. Then the end cap component 40, which has been welded into the distal end of the handle 22, is threaded onto the transfer screw 38 until the leading edge of the thimble 19 comprising minor increments 19a aligns with the lowest graduated scale 18a increment requiring calibration, for example, 20% of a full scale. The lock ring 21 then secures the setting at this value. Thereupon, the transfer screw 38 is rotated, with a standard hex wrench inserted into socket 38a FIG. 6, compressing the spring 34 until the tool releases during repeat testing at the 20% of full scale setting. The handle lock screw 21a is tightened to secure the setting. Low end calibration is now complete without the use of shims or spacer washers.

Thereafter, the handle 22 is rotated to full scale reading as indicated by the micrometer scale 18a and thimble 19 alignment. The torque release value is checked on a torque tester, both in the clockwise and counterclockwise directions. To correct any unbalance, the wrench 50 is inserted from the handle end of the tool into the balance cam 32 and the balance cam is rotated to different positions at which the balance cf clockwise and counterclockwise release is rechecked until a proper match is achieved. This clockwise and counterclockwise balance is achieved without disassembling the tool.

A full scale reading is now compared with the testing machine reading to determine proper spring rate. If the testing machine reading is too high compared with the torque setting, the ball screw 28 must be turned clockwise, or counterclockwise if the testing machine reading is too low. The ball screw 28 is adjusted until the testing machine shows the desired correct reading. Such adjustment is accomplished using the simple hex wrench 44 inserted into the tool through the handle end. Rechecking and adjustment of the low end readings is effected if necessary. After the spring rate has been adjusted, the lock screw 31 is tightened against the ball screw 28 using the hex wrench 44a. It will be noted that the spring rate adjustment has been completed without the need for disassembling the tool or requiring any pivot block replacement.

It will be apparent that various modifications and/or additions may be made in the mechanism of the invention without departing from the essential features of novelty involved, which are intended to be defined and secured by the appended claims.

What is claimed is:

1. A torque control mechanism for wrenches and the like and having a drive head connected to one end of a force transmission member which is attached adjacent to said one end to a proximal end of an elongate tubular housing, and comprising:

a pivot block having one end rockably engaging a second end of said force transmission member;

an axially moveable plunger having one end rockably opposing a second end of said pivot block;

a ball screw axially threadedly adjustable in a throughbore in said plunger and having pivot controlling ball means for projecting into engagement in a complementary socket in said second end of said pivot block;

balance cam means cooperatively related to a second end of said plunger for controlling balanced release values between clockwise and counterclockwise torque valuations;

coiled compression biasing spring means seated at one end on said balance cam means for applying biasing thrust toward said plunger;

antifriction means for compression engagement of a second end of said spring means;

rotatably adjustable transfer screw means having an end engaging said antifriction means for controlling the thrust load of said spring means;

a stop adjusting nut mounted in the distal end portion of said tubular housing and having said transfer screw means threaded therethrough;

an end cap fixed within a distal end of a handle mounted about a distal end portion of said tubular housing and having said transfer screw means threaded therethrough;

said transfer screw means having wrench engageable means for rotatably adjusting said transfer screw means axially in said stop adjusting nut for effecting said adjusting of the thrust load of said biasing spring means; and said transfer screw means, said antifriction means, said spring means, and said balance cam means providing continuous passage therethrough for access from the distal end of the handle by an adjustment wrench to said ball screw for controlling projection distance of said pivot controlling ball means relative to said plunger.

2. A torque control mechanism according to claim 1, wherein said tubular housing has at an intermediate area thereon an increment adjustment scale, a thimble cooperatively related to said scale encircling said housing, a locking ring encircling said housing and assembled with said thimble, a lock ring engageable with said locking ring retainer, and a tubular handle mounted about a distal end portion of said housing and attached to said lock ring.

3. A torque control mechanism according to claim 1, including lock screw means threaded in said throughbore in said plunger for locking the ball screw in selected adjusted positions in said plunger.

4. A torque control mechanism for wrenches and the like and having a drive head connected to one end of a force transmission member which is attached adjacent to said one end to a proximal end of an elongate tubular housing, and comprising:

a pivot block having one end rockably engaging a second end of said force transmission member;

an axially moveable plunger having one end rockably opposing a second end of said pivot block; and a ball screw axially threadedly adjustable in a throughbore in said plunger and having pivot controlling ball means for projecting into engagement in a complementary socket in said second end of said pivot block.

5. A mechanism according to claim 4, including a lock screw threaded in said throughbore for locking said ball screw in selected adjusted positions.

6. A torque control mechanism according to claim 5, including means for effecting threaded adjustments of said ball screw and said lock screw in said plunger.

7. A torque control mechanism for wrenches and the like and having a drive head connected to one end of a force transmission member which is attached adjacent to said one end to a proximal end of an elongate tubular housing, and comprising:

a pivot block having one end rockably engaging a second end of said force transmission member;

an axially moveable plunger having one end rockably opposing a second end of said pivot block;

balance cam means cooperatively related to a second end of said plunger for controlling balanced release values between clockwise and counterclockwise torque valuations; and coiled compression biasing spring means seated at one end on said balance cam means for applying biasing thrust toward said plunger.

8. A torque control mechanism according to claim 7, wherein said plunger has a stem rotatably engaged within a complementary bore in said balance cam means, and said bore is eccentric to the axis of said stem so that by rotating the balance cam means, a balance between clockwise and counterclockwise adjustment can be effected for the torque control mechanism.

9. A torque control mechanism according to claim 8, wherein said one end of said spring means is in frictional co-rotatable engagement with said cam means, antifriction means for compression engagement of a second end of said spring means, and rotatably adjustable transfer screw means having an end engaging said antifriction means and operable for adjusting the thrust load of said spring means.

10. A torque control mechanism for wrenches and the like and having a drive head connected to one end of a force transmission member which is attached adjacent to said one end to a proximal end of an elongate tubular housing, and comprising:

a pivot block having one end rockably engaging a second end of said force transmission member;

an axially moveable plunger assembly having one end rockably opposing a second end of said pivot block;

coiled compression biasing spring means seated at one end in frictional engagement with said plunger assembly and thrusting theretoward;

antifriction means for compression engagement of a second end of said spring means;

a rotatably adjustable transfer screw having an end engaging said antifriction means;

a stop adjusting nut mounted in a distal end portion of said tubular housing and having said transfer screw means threaded therethrough; and means for retaining said transfer screw means in fixed adjusted positions relative to said stop adjusting nut.

11. A torque control mechanism according to claim 10, wherein said means for retaining said transfer screw in adjusted positions comprises an end cap fixed within a distal end of a handle mounted about a distal end portion of said tubular housing and having said transfer screw threaded therethrough.

12. A torque control mechanism according to claim 11, wherein said transfer screw means includes wrench engageable means for rotatably adjusting the transfer screw means axially for adjusting the thrust load of the biasing spring means, and said end cap has means for effecting locking of said transfer screw means in the end cap.

13. A torque control mechanism for wrenches and the like and having a drive head connected to one end of a force transmission member which is attached adjacent to said one end to a proximal end of an elongate tubular housing, and comprising:

a pivot block having one end rockably engaging a second end of said force transmission member;

an axially moveable plunger having one end rockably opposing a second end of said pivot block;

a ball screw axially threadedly adjustable in a throughbore in said plunger and having pivot controlling ball means for projecting into engagement in a complementary socket in said second end of said pivot block;

biasing spring means for applying axial biasing thrust toward said plunger;

means for adjusting the biasing thrust of said biasing means; and said biasing spring means and said thrust adjusting means providing continuous passage therethrough for access by an adjustment wrench to said ball screw for controlling projection of said pivot ball means relative to said plunger.

14. A torque control mechanism according to claim 13, including means for effecting linearity adjustment of said plunger.

15. A torque control mechanism according to claim 14, wherein said means for effecting clockwise and counterclockwise balance adjustment comprises a balance cam means mounted on said plunger and providing a thrust seat for said biasing spring means.

16. A torque control mechanism according to claim 15, wherein said thrust seat retains said biasing spring means frictionally, and antifriction biasing thrust means engaging an opposite end of said biasing spring means for permitting adjustment rotation of said biasing spring means.

17. A torque control mechanism according to claim 16, including a transfer screw thrusting toward said antifriction means, and means for effecting thrust adjustments of said transfer screw.

18. A torque control mechanism according to claim 17, including means for locking said transfer screw in adjusted positions.

19. A torque control mechanism according to claim 18, wherein said locking means includes a control handle mounted on said tubular housing.

* * * * *